US007914473B2

(12) United States Patent
Josey

(10) Patent No.: US 7,914,473 B2
(45) Date of Patent: Mar. 29, 2011

(54) POSTURE TRAINING DEVICE

(75) Inventor: Lorraine Kay Josey, Buderim (AU)

(73) Assignee: Backtone Pty Ltd, Buderim, Queensland (AU)

( * ) Notice: Subject to any disclaimer, the term of this patent is extended or adjusted under 35 U.S.C. 154(b) by 206 days.

(21) Appl. No.: 12/062,449

(22) Filed: Apr. 3, 2008

(65) Prior Publication Data

US 2008/0319364 A1 Dec. 25, 2008

(30) Foreign Application Priority Data

Apr. 5, 2007 (AU) ..... 2007901830

(51) Int. Cl.
*A61F 5/00* (2006.01)

(52) U.S. Cl. ..... 602/19; 600/594

(58) Field of Classification Search ..... 602/17–19, 602/32–36; 128/882, 874–875; 600/502, 600/594

See application file for complete search history.

(56) References Cited

U.S. PATENT DOCUMENTS

| | | | | | |
|---|---|---|---|---|---|
| 3,608,541 | A | * | 9/1971 | Hall | 600/594 |
| 4,007,733 | A | * | 2/1977 | Celeste et al. | 600/594 |
| 4,108,164 | A | * | 8/1978 | Hall, Sr. | 600/594 |
| 4,237,341 | A | * | 12/1980 | Richards | 381/75 |
| 4,434,801 | A | * | 3/1984 | Jiminez et al. | 600/502 |
| 4,750,480 | A | * | 6/1988 | Jenness | 602/19 |

FOREIGN PATENT DOCUMENTS

| | | |
|---|---|---|
| AU | 2001-67103 B2 | 3/2002 |
| WO | WO 91/06082 | 5/1991 |

* cited by examiner

*Primary Examiner* — Michael A. Brown
(74) *Attorney, Agent, or Firm* — Knobbe Martens Olson & Bear LLP

(57) ABSTRACT

The invention resides in a posture training device comprising a signalling unit able to be worn longitudinally over a user's spine, the signalling unit having two ends that can be used to activate the signalling unit by tension being applied to either of the two ends; a waist strap able to be fitted around a waist of a user, the waist strap connected to one of the ends of the signalling unit; and a central strap able to extend adjacent the spine of a user, the central strap being connected to an opposing end of the signalling unit and to the waist strap.

9 Claims, 6 Drawing Sheets

POSTURE TRAINING DEVICE

FIELD OF THE INVENTION

This invention relates to a posture training device. In particular, the device relates to training an individual to maintain movement patterns to ensure good posture.

BACKGROUND OF THE INVENTION

Good posture is an important element for maintaining optimal health and wellbeing. Good posture aids in recovery following injury and assists with growth and development. Correct posture contributes greatly to appearance and it can have a significant impact upon self esteem and general fitness. For many people, adopting good postural habits is difficult. Issues with maintaining good posture such as awareness of body position, muscle strength and endurance may present difficulties for people who are going through the process of changing their posture.

There are many different types of posture training devices including those disclosed in U.S. Pat. No. 4,750,480 and International patent application number WO 91/06082. Both of these posture devices provide feedback to a user when correct posture is not being maintained. Both of these devices provide the feedback on specific areas of a person's body. However, generally when a person's breastbone is lifted vertically then a person's posture will be correct. Neither of these prior art documents address this aspect of good posture.

Applicant's co-pending Australian patent application number 67103/01 describes a posture training device. This posture training device includes a signalling unit that is attached at one end to a waist strap with the other end of the signalling device attached to a pair of shoulder straps. This posture training device operates very effectively to provide feedback on a person's posture when they are at a front facing position. However, when rotation of the body occurs the shoulder straps can cause activation of the signalling unit due to movement of a person's shoulders. This can become annoying for a wearer so that they discontinue wearing the posture training device. Further, a person can become confused thinking they are not maintaining a good posture when in fact they are.

OBJECT OF THE INVENTION

It is an object of the invention to overcome or alleviate one or more of the above disadvantages or provide the consumer with a useful or commercial choice.

SUMMARY OF THE INVENTION

In one form, although not the only or broadest form, the invention resides in a posture training device comprising;

a signalling unit able to be worn longitudinally over a user's spine, the signalling unit having two ends that can be used to activate the signalling unit by tension being applied to either of the two ends;

a waist strap able to be fitted around a waist of a user, the waist strap connected to one of the ends of the signalling unit; and a central strap able to extend adjacent the spine of a user, the central strap being connected to an opposing end of the signalling unit and to the waist strap.

The posture training device may include a body strap that holds the central strap adjacent the spine of the user.

Preferably the body strap includes two shoulder straps attached to the central strap to hold the central strap adjacent the spine of the user. The shoulder straps may also be connected to the waist strap or adjacent a lower portion of the central strap.

Alternatively, the body strap is a collar attached to the central strap to hold the central strap adjacent the spine of the user.

The signalling unit may emit an audible signal and/or a vibration signal.

BRIEF DESCRIPTION OF THE DRAWINGS

Embodiments of the invention will now be described with reference to the accompanying figures.

DETAILED DESCRIPTION OF THE PREFERRED EMBODIMENTS

Figure 1A:
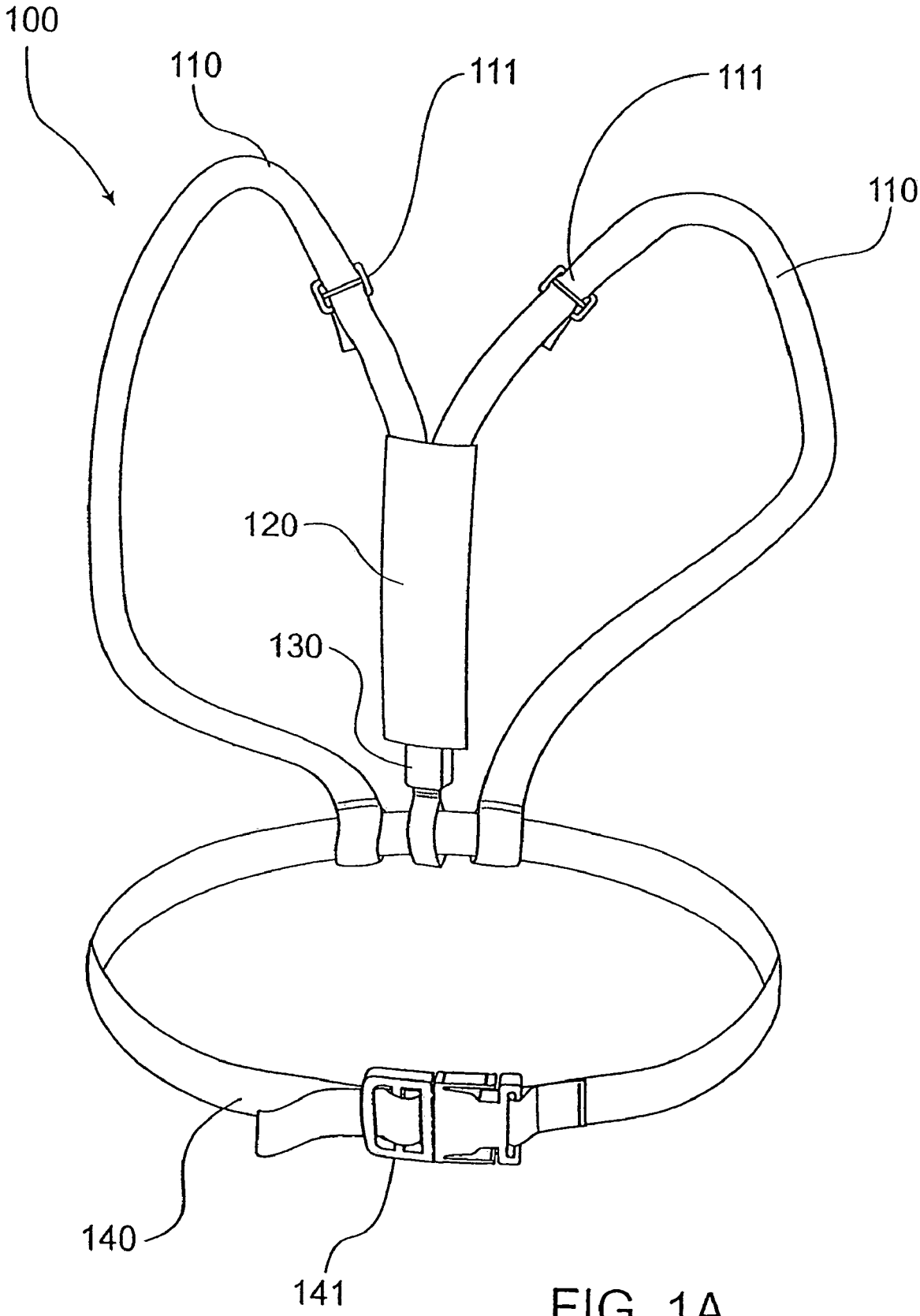
FIG. 1A shows a perspective view of a posture training device according to a first embodiment of the device.
Figure 1B:
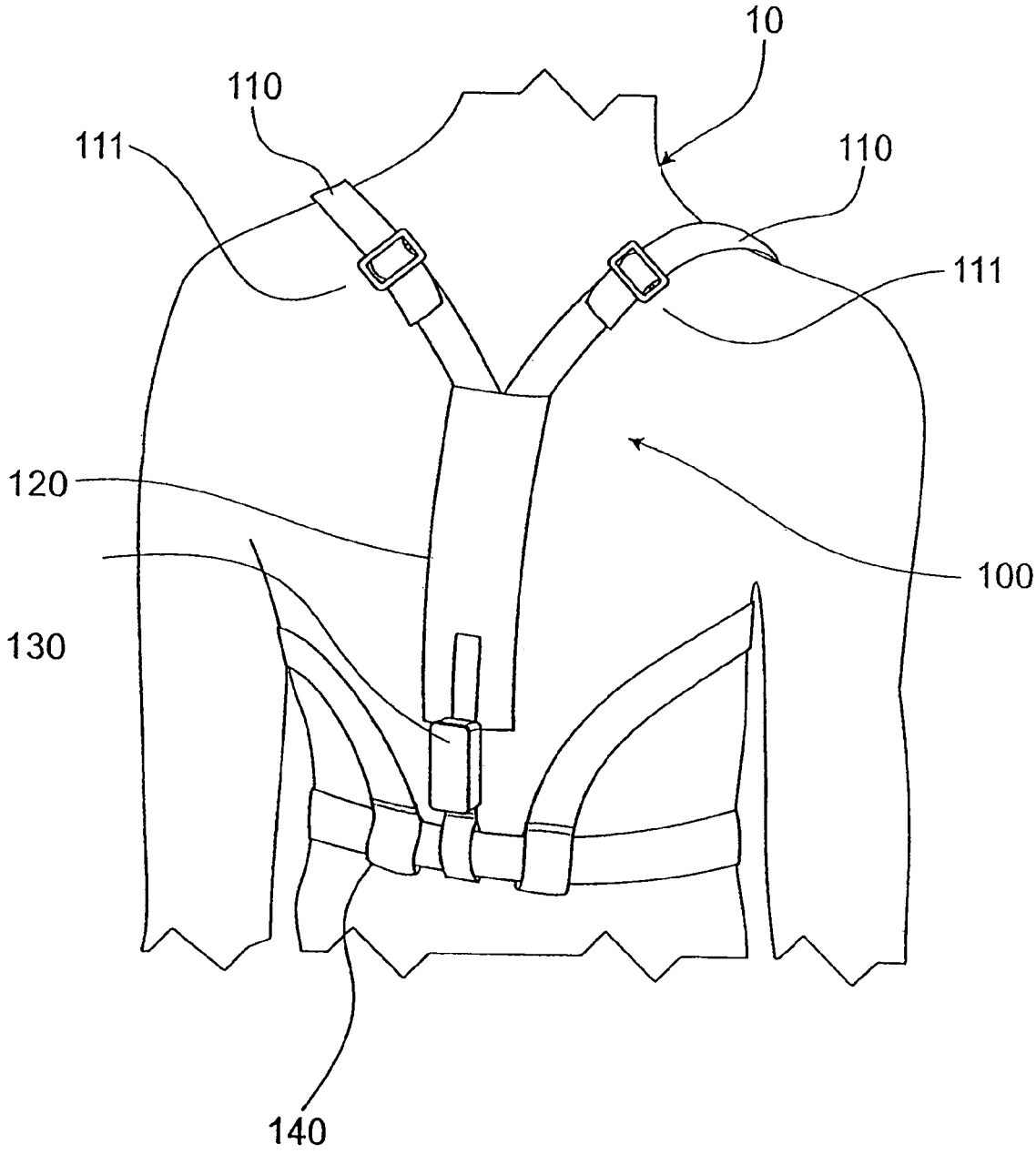
FIG. 1B shows a perspective view of a user wearing the posture training device of FIG. 1A.

FIG. 1A and FIG. 1B show a posture training device 100 to train a user 10 to maintain correct posture. The invention includes two shoulder straps 110, a central strap 120, a signalling device 130 and a waist strap 140. The shoulder straps 110 are connected to the central strap 120 and to the waist strap 140. The shoulder straps 110 are flexible and made from a non-elastic strap. Adjustment buckles 111 are located on each shoulder strap 110 to adjust the length of the respective shoulder strap 110.

The waist strap 140 is also made from a non-elastic material. An adjustment clip 141 is located at an end of the waist strap 141 to adjust the length of the waisted strap 141.

The signalling device 130 is connected to the central strap 120 and the waist strap 140 as shown.

FIG. 1B shows posture training device 100 worn by a wearer 10. The wearer 10 adjusts the length of the waist strap 140 and the shoulder straps 110 whilst maintaining good postural position of the back, neck and shoulders. The signalling unit 130 will remain deactivated so long as good postural position is maintained. If the upper spine or shoulders of the wearer slouch forward beyond a desired position, opposing forces are exerted on the signalling device 130 by the waist strap 140 and the central strap 120. This causes the ends of the signalling unit 130 to be extended thereby activating the signalling unit 130.

Preferably, the signalling unit 130 has two biased extensions that are connected to the central strap 120 and the waist strap 140. When a force is applied to either extension to overcome the biasing force on the extensions, the extensions move. The signalling unit 130 preferably uses a magnetic reed switch type circuit as is known in the art to detect this movement and thus activate the signalling unit 130.

When the signalling unit 130 is activated, the signalling unit 130 preferably emits an auditable tone from a speaker or the like. Optionally, the signalling unit 130 may also vibrate in a fashion similar to a mobile phone.

When the wearer 10 readjusts their body position and returns to the state of desired posture, the ends of the signalling unit 130 return to their resting position at which time the signalling unit 130 will be deactivated.

Figure 2A:
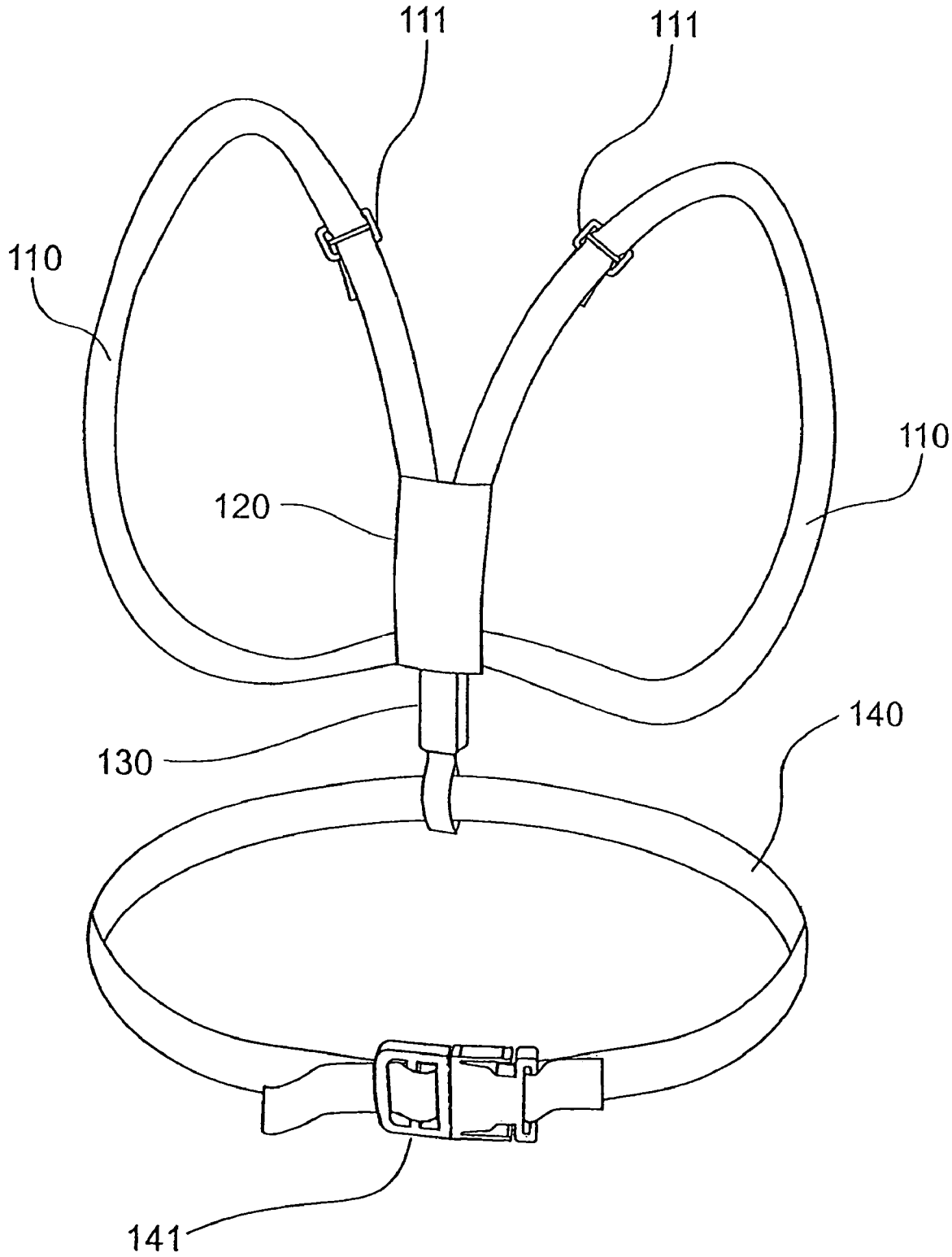
FIG. 2A shows a perspective view of a posture training device according to a second embodiment of the invention.
Figure 2B:
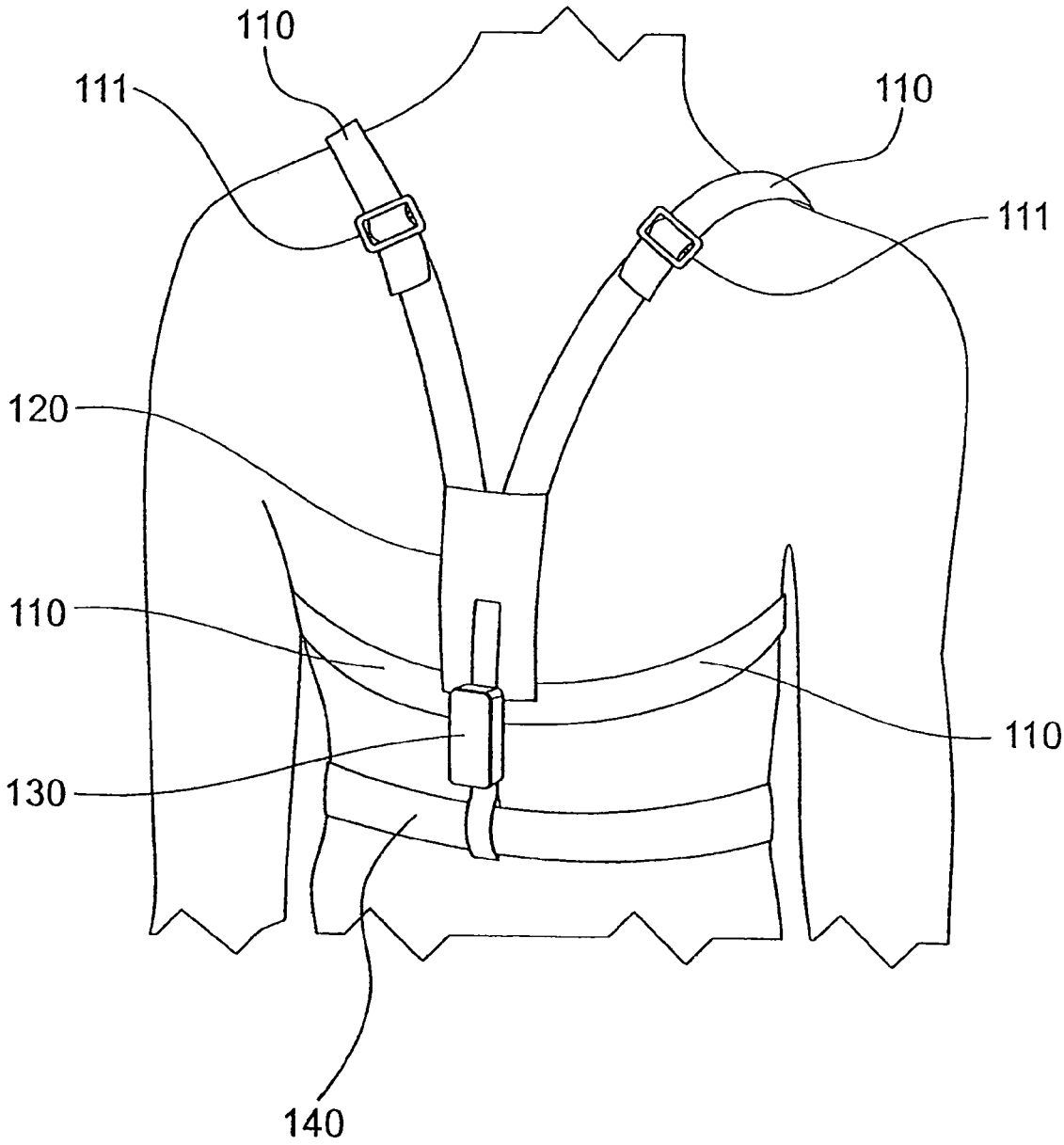
FIG. 2B shows a user wearing the posture training device of FIG. 2A.

FIG. 2A and FIG. 2B show a second embodiment of the invention. In this embodiment the shoulder straps 110 are connected to a lower portion of the central strap 120 instead of the waist strap. This allows for smaller framed people such as children to wear the posture training device 100 of the invention.

Figure 3A:
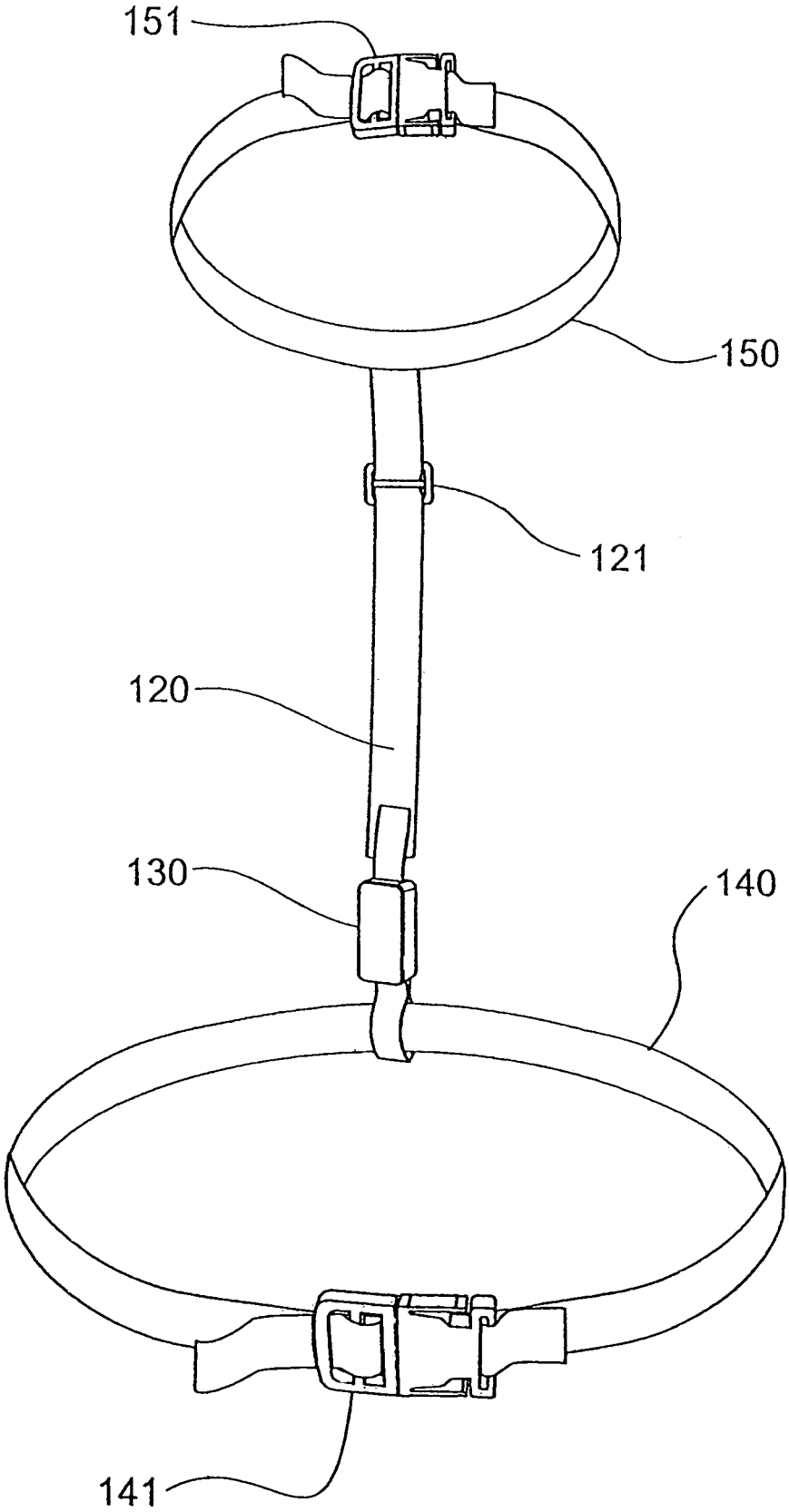
FIG. 3A shows a perspective view of a posture training device according to a third embodiment of the invention.
Figure 3B:
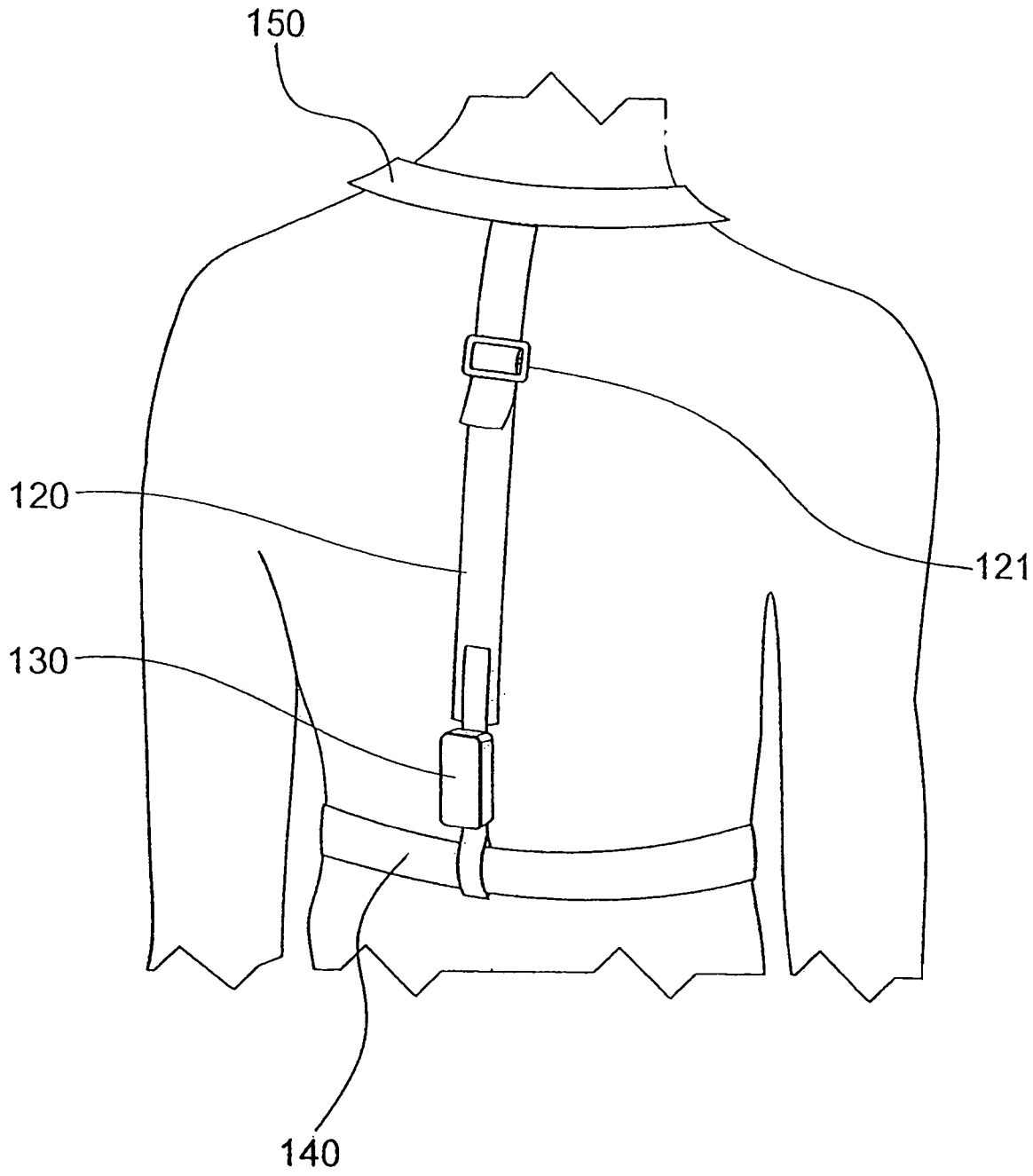
FIG. 3B shows a user wearing a posture training device of FIG. 3A.

FIG. 3A and FIG. 3B show yet another alternative embodiment in which the shoulder straps 110 have been replaced by a collar 150. The collar 150 is adjustable in length and has an adjustment clip 151 similar to the adjustment clip 141 of the waist strap 140 to adjust the length of the collar 150. Furthermore, the central strap 120 has an adjustment clip 121 to adjust the length of the adjustment strap 120.

The advantage to the embodiments described above over the prior art embodiments is that the force applied to the signalling unit is generally along the spine. Therefore any twisting motion that occurs is less likely to activate the signalling unit. A user is therefore more likely to wear the training unit for the desired period of at least twenty minutes per day to train the muscles to maintain good posture.

Throughout the specification the aim has been to describe the invention without limiting the invention to any one embodiment or specific collection of features. Persons skilled in the relevant art may realize variations from the specific embodiments that will nonetheless fall within the scope of the invention.

It will be appreciated that various other changes and modifications may be made to the embodiment described without departing from the spirit and scope of the invention.

The invention claimed is:

1. A posture training device comprising;

a signalling unit able to be worn longitudinally over a user's spine, the signalling unit having two ends that can be used to activate the signalling unit by tension being applied to either of the two ends;

a waist strap able to be fitted around a waist of a user, the waist strap connected to one of the ends of the signalling unit and configured to apply tension to the one of the ends of the signalling unit; and a central strap able to extend adjacent the spine of a user, the central strap being connected to an opposing end of the signaling unit and configured to apply tension to the opposing end of the signalling unit.

2. The posture training device of claim 1 further including a body strap connected to the central strap.

3. The posture training device of claim 2 wherein the body strap includes two shoulder straps attached to the central strap.

4. The posture training device of claim 3 wherein the shoulder straps are connected to the waist strap.

5. The posture training device of claim 2 wherein the shoulder straps are connected to a lower portion of the central strap.

6. The posture training device of claim 1 wherein the body strap is a collar.

7. The posture training device of claim 1 wherein the signalling unit emits an audible signal.

8. The posture training device of claim 1 wherein the signalling unit emits a vibration signal.

9. The posture training device of claim 1 wherein the signalling unit comprises a magnetic reed switch.

* * * * *